United States Patent [19]

Oshinsky

[11] Patent Number: 4,502,525

[45] Date of Patent: Mar. 5, 1985

[54] PATTERNS FOR A COUPLER YOKE CASTING

[75] Inventor: Frank W. Oshinsky, McKeesport, Pa.

[73] Assignee: McConway & Torley Corporation, Pittsburgh, Pa.

[21] Appl. No.: 31,643

[22] Filed: Apr. 19, 1979

[51] Int. Cl.[3] ..... B22C 7/04

[52] U.S. Cl. ..... 164/241; 164/249

[58] Field of Search ..... 164/235, 239, 241, 243, 164/240, 242, 249; 425/806

[56] References Cited

U.S. PATENT DOCUMENTS 1,555,999 10/1925 Loveless ..... 164/243

4,138,086 2/1979 Mizutani et al. ..... 425/806 X

FOREIGN PATENT DOCUMENTS 2121 7/1862 United Kingdom ..... 164/243

*Primary Examiner*—Nicholas P. Godici

*Attorney, Agent, or Firm*—Thomas H. Murray; Clifford A. Poff

[57] ABSTRACT

The drag pattern and the cope pattern for a standard AAR coupler yoke are each mounted on a pattern plate to form an oblique angle of about 1° between the mounting surface of the pattern plate and a plane parallel to a longitudinal center plane of the pattern. The patterns each include core print surfaces for establishing the position of one unitary core which is used in a sand mold to form surfaces in the coupler yoke at the front end portion thereof. The drag pattern includes pattern surfaces to mold sand to form the surfaces surrounding the draft gear pocket on the upper and lower straps and the rear draft gear seat at the rear end portion of the yoke. The draft gear seat is generally planar and perpendicular with each inside wall of top and bottom straps.

12 Claims, 6 Drawing Figures

PATTERNS FOR A COUPLER YOKE CASTING

BACKGROUND OF THE INVENTION

This invention relates to patterns used in mold flasks to mold sand for casting a standard AAR coupler yoke for a railway vehicle wherein cope and drag pattern parts are constructed to form an oblique relationship between the horizontal yoke pattern center plane and the pattern plates defining the parting line between cope and drag flasks.

As is well known in the art, railway vehicles are connected together by couplers that are supported by, inter alia, coupler yokes carried on the railway vehicles. A coupler yoke is a casting having a pocket to receive and maintain a draft gear assembly in operative contact with the coupler so that the forces applied to the coupler head are dampened by the gear. In freight car draft arrangements, a rectangularly-shaped block of metal is interposed between the butt end of the coupler shank and the front working end of the draft gear. This rectangularly-shaped metal block, usually referred to as a front follower, extends crosswise through the front end of the yoke draft gear pocket. The draft gear is compressible and moves in the draft gear pocket through a distance of travel afforded by the design of the draft gear and sill stops. Side walls at the front end of the coupler yoke form a coupler pocket to receive the butt end of the coupler shank. The yoke at its front end is joined to the shank of a coupler by a horizontal connecting cross-key in an E-type coupler, or by a vertical pin in an E/F-type coupler and an F-type coupler. Except for heat treatment, gaging and rough grinding, the coupler yoke casting is used, as cast, to transmit pull and buff forces to the draft gear in train service.

Standard AAR E-type coupler yokes and F-type coupler yokes are unitary castings each embodying a somewhat similar design of top and bottom straps extending rearwardly to an interconnecting rear end portion having lightener holes at its opposite faces and a rear draft seat at right angles to the top and bottom straps. From the rear end portion, the top and bottom straps have a substantially uniform width along the major portion of their length to a point where an enlargement to their width forms a short transition zone extending to the front end portion of the coupler yoke. In an E-type coupler yoke, a key slot is formed in the head end side walls extending between the top and bottom strap portions and forwardly to a nose or jaw. The nose has outwardly-diverging side walls to accommodate lateral movement of the coupler shank. The side walls of the front end portion are also formed with front block follower seats which face toward the rear draft gear seat. In an F-type coupler yoke, the front end portion forwardly of the front follower seats has a bored pinhole in the top and bottom walls extending forwardly from the top and bottom straps. Walls usually called "head end side straps" interconnect the walls containing the bored connecting pinhole and form a coupler pocket to receive a butt part of an E/F-type or an F-type coupler shank.

Conventionally, cores are used in the cavity of a sand mold to produce a coupler yoke casting. Cope and drag patterns for a standard coupler yoke usually require the use of 11 separate core members produced from seven different designs of core boxes. The multiplicity of cores is undesirable because it requires an excessive amount of facilities, labor and finishing operations for the resulting casting. For example, a matching set of cope and drag cores as set in drag flask molds, require grinding to provide the required height and assure flat mating surfaces. Cope and drag cores were also pasted and banded together for use in the drag molds of the flasks. Other core finishing operations include repairs to overcome surface defects. All the cores are manually set in the drag mold and anchored at the desired position. After the cope and drag flasks are joined together with the cores in place, movement to the pouring floor sometimes produced unwanted shifting of the cores and/or flasks which cannot be detected until after the casting is removed from the mold. Excessive hand grinding operations are required because of the multiplicity of the cores. More recently, coupler yoke castings are produced by the use of a single head end core in the cope and drag flasks of a mold. However, an excessive number of defective yoke castings still occur because of defects caused by misaligned core and mold surfaces of the casting.

The present invention is addressed to a novel pattern assembly to mold sand in the cope and drag flasks of a mold in a manner to facilitate the use of a single core. In the past, when a single core was used throughout a mold, the cope-to-drag parting line was chosen to correspond to one longitudinal center plane of the coupler yoke casting. The cavities in the cope and drag molds formed, with the core member, equal halves of the yoke casting. The parting line extended the full length of the strap sections inside and outside thereof midway of the strap mold height. Yoke castings are usually molded on their sides, i.e., reorientated at an angle of 90° from their usual operative position.

The parting line defined by the cope and drag has also been arranged to extend about one inch from the side edge of the straps. In this way, the patterns are designed so that the drag portion includes about four inches of the molded strap height and the cope portion includes the remaining part of the straps which is about one inch. The parting line of the patterns and the molds applies to the internal parts of the casting as well as the external wall surfaces. The pattern parts are mounted on perfectly flat plates or boards with the face surfaces defining the parting line. The selection of the parting line for a coupler yoke casting was in the past characteristically chosen because of the overwhelming symmetrical design about longitudinal center planes of the castings. This invention is addressed to the novel concept for providing yoke mold patterns for mounting upon pattern plates that define a parting line between cope and drag molds that eliminate disadvantages arising out of traditional selection of a parting line that required yoke draft gear pocket cores and producing a casting requiring excessive finishing operations, particularly at critical areas requiring relatively smooth surfaces without fins or ribs and of close dimensional tolerances.

SUMMARY OF THE INVENTION

It is an object of the present invention to provide a drag pattern and a cope pattern for use to mold sand in a flask for casting a coupler yoke for a railway vehicle wherein the parting line for the patterns as defined by the support surface of pattern plates forms an oblique angle with respect to the horizontal center plane of the mold cavity, hence, also the corresponding longitudinal center plate of the coupler yoke casting.

It is a further object of the present invention to provide a drag pattern and a cope pattern for molding sand in flasks for a mold to produce a coupler yoke casting wherein the parting line between the mold sand in the flasks is vertically offset with respect to inside and outside walls of the straps and rear end portion of the yoke whereby the cope and drag patterns establish a parting line in the side edge of the strap on the inside walls thereof and along the lengthwise line oblique to the center line on the outside walls thereof.

More particularly, according to the present invention, there is provided a drag pattern to mold sand in a drag flask for cooperative use with a cope flask for casting a coupler yoke for a railway vehicle wherein the coupler yoke includes a rear end portion having a rear draft gear seat at a generally right angle relation with each inside wall of top and bottom straps extending in a generally parallel and spaced-apart relation at either side of a first longitudinal center plane of the coupler yoke from the rear end portion to a front end portion having front follower block seats facing toward the rear draft seat, a draft gear pocket being defined within the area surrounded by the rear draft gear seat, the front follower seats and the top and bottom straps, each of the straps having a midportion with an opposed side edge uniformly spaced from a second longitudinal center plane perpendicular to the first longitudinal center plane, the drag pattern assembly including a pattern plate, a drag pattern defining part of the center plane of the pattern corresponding to and parallel with the second longitudinal center plane of the ultimate coupler yoke casting, the drag pattern including a planar support surface for contact with the pattern plate, the planar support surface being oblique to the pattern longitudinal center plane, and fastening means to mount the drag pattern onto the support surface of the pattern plate whereby the center plane of the pattern extends obliquely to the face surface of the pattern plate which contacts the drag flask and essentially establishes the plane of the parting line of the sand mold.

In the preferred form, the aforementioned drag pattern assembly includes sand molding surfaces oblique to the plane of the parting line forming at least part of one side edge of the yoke straps along the midportion thereof. The sand molding surfaces of the drag mold pattern further include obliquely arranged molding surfaces to the plane of the parting line to define the draft gear seat.

The aforementioned oblique relationship between the pattern plate and the pattern supported thereby are equally defined in the same manner with respect to the cope pattern whereby the cope pattern has a longitudinal center plane oblique to the planar support surface therefor provided by the pattern plate.

These features and advantages of the present invention as well as others will be more fully understood when the following description is read in light of the accompanying drawings, in which.

Figure 1:
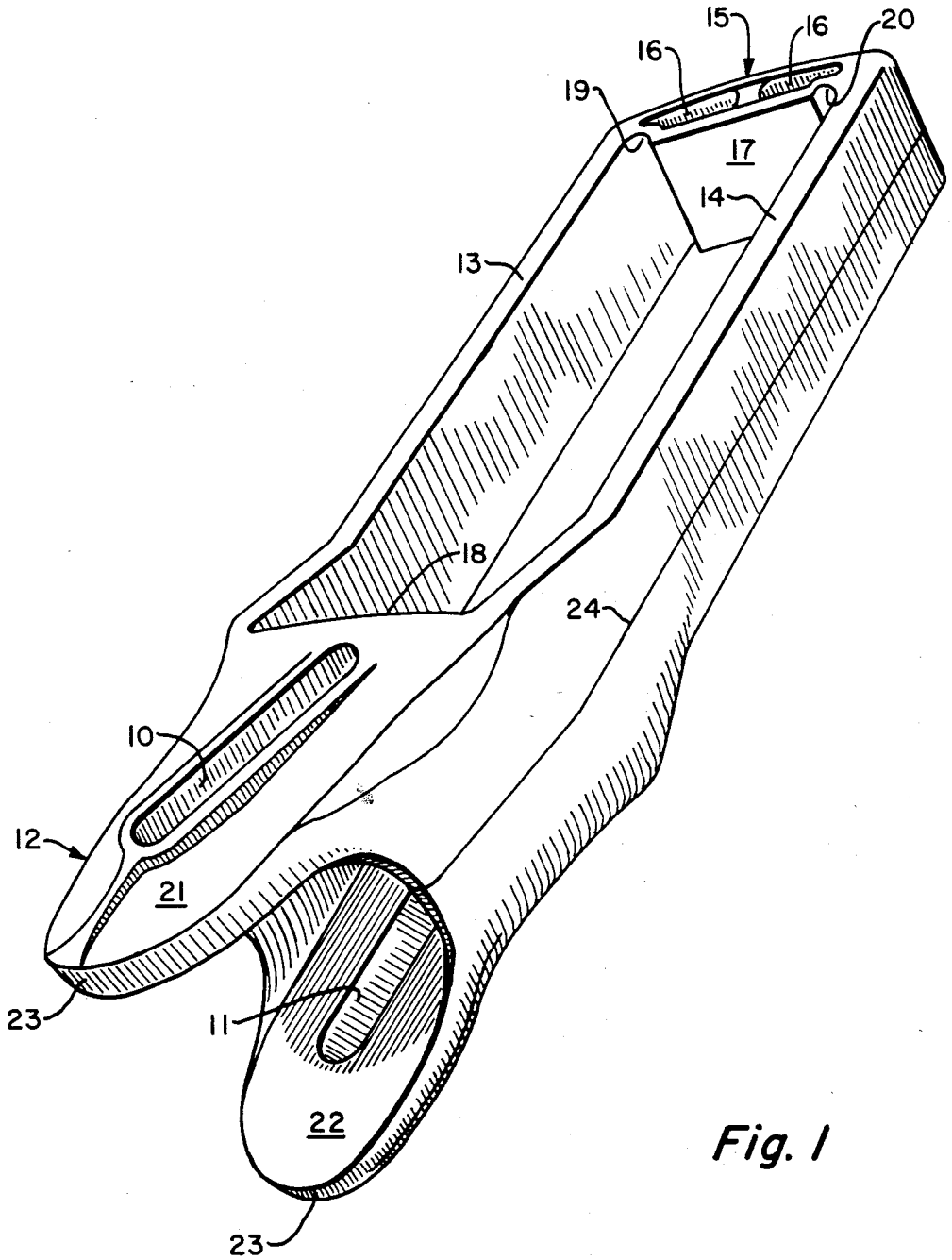
FIG. 1 is a view, in perspective, of a standard AAR E-type coupler yoke casting produced, in part, through the use of the patterns embodying the features of the present invention.
Figure 5:
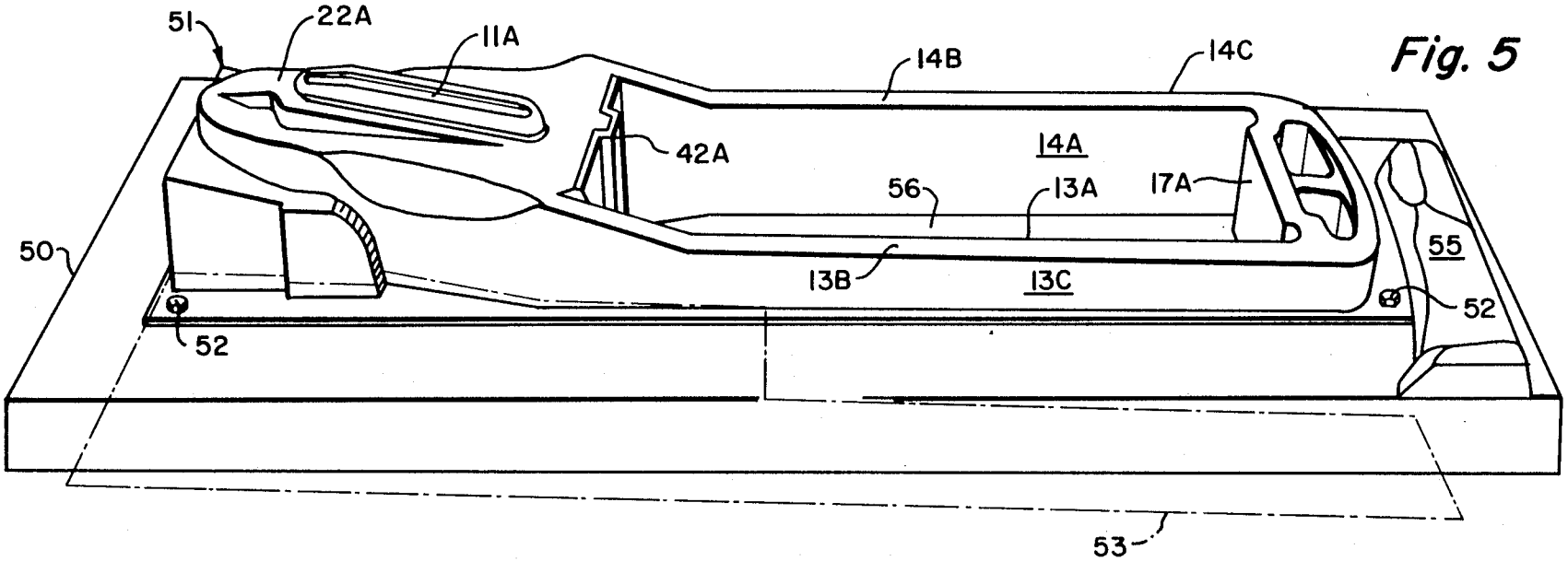
FIG. 5 is a perspective view of a drag mold pattern embodying the features of the present invention.
Figure 6:
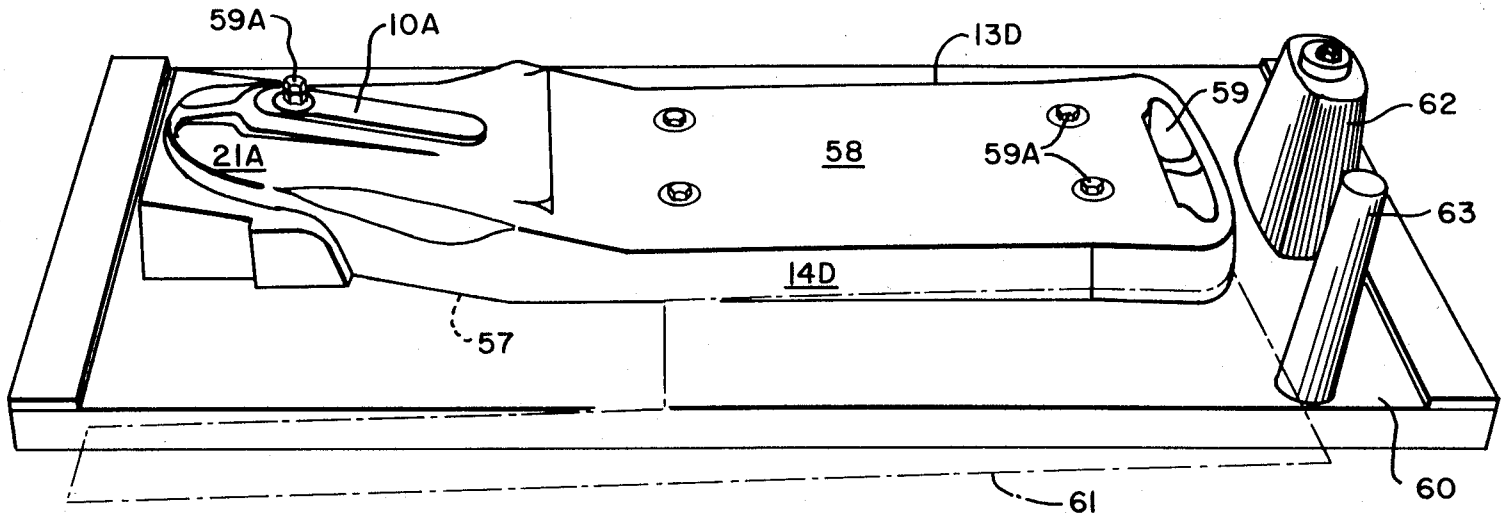
FIG. 6 is a perspective view of a cope pattern embodying the features of the present invention.

FIG. 1 illustrates a standard AAR E-type coupler yoke which is cast in a sand mold with a cavity formed by the use of the pattern assemblies shown in FIGS. 5 and 6 embodying the features of the present invention. The coupler yoke shown in FIG. 1 is an integral casting used, inter alia, for connecting a coupler to a draft gear and to the striker and center sill of a railroad car. The orientation of the coupler yoke shown in FIG. 1 is the same as that as when in operative use. It is generally characterized by the horizontally-aligned key slots 10 and 11 in the front end 12 connected by top and bottom straps 13 and 14, respectively, to a rear end portion 15. The rear end portion is essentially a vertical wall with lightener pockets 16 in the edge faces thereof. The rear end portion 15 defines a rear draft gear seat 17. Seat 17 is a generally flat face surface to abut against a draft gear inserted into the rectangular area, generally known as a draft gear pocket, which is bounded by the top and bottom straps, the rear draft gear seat and extends forwardly toward, but spaced from, front follower block seats 18. A follower, generally a rectangularly-shaped plate member, is interposed between the front follower block seats 18 and the draft gear when operatively-arranged within the draft gear pocket. The draft gear pocket in some standard E-type coupler yokes is 25 inches long. One of the requirements of a standard AAR coupler yoke is that the rear draft gear seat 17 forms a 90° angle with the inside wall surface of each of the top and bottom straps 13 and 14. This important relationship is readily and consistently obtainable by employing the patterns of the present invention without the need to utilize a core to form the seat. The rear draft seat 17 terminates at upper and lower relief areas 19 and 20. Forwardly of areas 19 and 20 the walls of the upper and lower straps have a substantially uniform width and thickness throughout the major length thereof which is the midportion to a point at which the width increases forming a transition section joined to the front end 12. The front end includes side walls 21 and 22 which diverge outwardly along their lengths toward the terminal end which is defined as a nose or jaw 23 of the yoke. The area between the walls 21 and 22 is designed to receive the rear part of a shank of a coupler with the usual horizontal key slot therein aligned with the key slots 10 and 11 for interconnection by means of the key.

Figure 2:
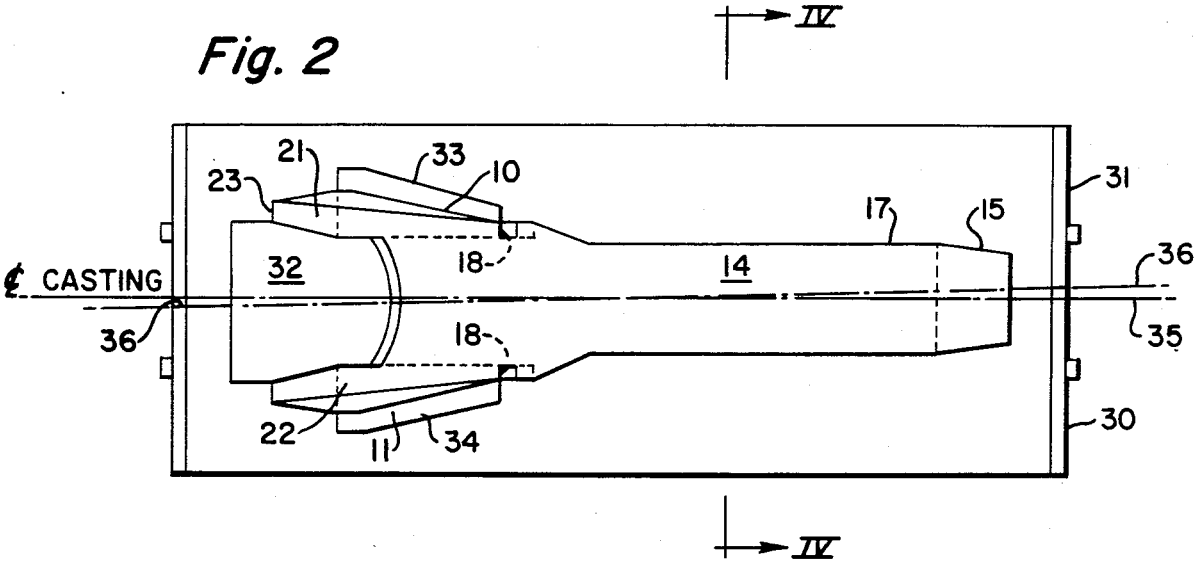
FIG. 2 is an elevational view of a sand mold broken away to show the casting, core and molded sand component parts thereof.
Figure 3:
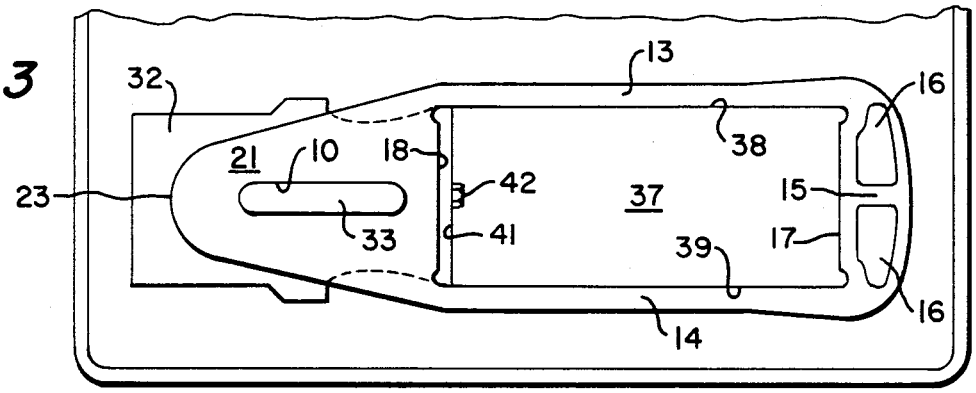
FIG. 3 is a plan view of the drag mold with the casting superimposed in the molded sand cavity formed by the pattern of the present invention as well as the core element used in the mold.

In light of the foregoing description and illustration of FIG. 1, the symmetry of the yoke about a horizontal center plane and a vertical center plane is apparent. The upper and lower straps 13 and 14 have the same shape and dimension along their lengths and are uniformly spaced from the horizontal center plane. The conventionally-defined vertical center plane has been traditionally the parting line between the mold parts which is usually visible by the occurrence of a protruding rib which is identified in FIG. 1 by reference numeral 24. The side walls 21 and 22 are symmetrically disposed and equally spaced from the vertical center plane of the casting when oriented in its operative relation as shown in FIG. 1. In the casting process, however, the yoke is cast in a mold cavity which is orientated at an angle of 90°; that is, the vertical center plane becomes the horizontal center plane during the casting process and the horizontal center plane becomes the vertical center plane during the casting process. In the sand mold, the top and bottom straps of the casting take the form of vertical side walls while the side walls 21 and 22 take the form of top and bottom walls. The reorientation of the coupler yoke for the casting process is clearly apparent by comparing FIG. 1 with FIGS. 2–4 wherein the parts of the yoke casting described above are identified by the same reference numerals. The yoke casting is shown in FIG. 2 in relation to a drag flask 30 and a cope flask 31. In FIGS. 2 and 3, a one-piece core 32 is used to form the internal hollowed-out area between walls 21 and 22 from the nose portion 23 and rearwardly to and including the front follower seats 18. The core includes upper and lower projections 33 and 34 that form in the ultimate casting the key slots 10 and 11. In FIG. 3, the casting is shown by an illustration wherein the mold parts are broken away to an elevation which reveals the top surface of the casting. According to the present invention, the patterns used to mold sand in the drag flask and cope flask of the mold are arranged on the pattern plate such that the horizohtal center plane of the casting when formed in the mold, and corresponding to the vertical center plane of the casting when operatively used, is oblique by an angle of inclination, preferably of 1°, to the parting line of the mold flasks.

The oblique relationship between the center plane of the casting and the parting line between the mold parts is indicated in FIG. 2 wherein reference numeral 35 identifies the horizontal center plane of the casting obliquely arranged in the mold and reference numeral 36 identifies the plane of the parting line between the drag flask 30 and the cope flask 31. The oblique relation of the casting in the mold is such that the rear end portion 15 is set deeper into the drag section 30, i.e., the height is not symmetrical with respect to the parting line 36. On the other hand, the front end portion 23 extends deeper into the cope flask than in the drag flask. One particular distinctive aspect of the present invention is clearly apparent from FIG. 4 wherein the patterns used to mold sand in the cope and drag flasks are constructed such that the drag pattern has an internal hollow portion substantially corresponding to the entire draft gear pocket except for the extreme forward end and forms, in the drag flask, an upstanding block 37 of molded sand which has vertical side walls 38 and 39 that define the entire inside face surface of the upper and lower straps, respectively, of the yoke casting. These strap face surfaces are relatively smooth and particularly characterized by the absence of a protruding rib. The upstanding block 37 of molded sand forms essentially the entire draft gear pocket between the side straps as well as the rear draft gear seat. The top of the upstanding block 37 of sand is closed off by a flat wall 40 of molded sand formed in the cope flask by a correspondingly-shaped cope pattern as will be described hereinafter. As is apparent from FIG. 3, the upstanding block 37 of sand includes, at its end face 41, a vertical guide slot 42 which is employed as a core print to locate and anchor the core 32 against the end face of the sand column. Other core prints are used in other areas of the same mold for similar purposes however it is particularly important to assure proper lateral location of the core with respect to the sand column so as to avoid detrimental shifting therebetween during movement of the mold after the core is set. Returning again to FIG. 4, it can be seen that the pocket of molded sand which is formed in the cope flask forms only the lateral edges of the upper and lower straps as well as about one-half of the outside face surfaces of the straps. At the outside face surfaces of the straps, the parting line between the cope and drag molds and flasks lies generally at the midportion of the outside face surfaces of the straps but because the straps are extended obliquely with respect to the parting line as described hereinbefore, the parting line is not parallel with the center plane of the straps along their extended length.

FIGS. 5 and 6 illustrate drag and cope pattern assemblies, respectively. The drag pattern assembly of FIG. 5 essentially includes a pattern plate 50 and a highly-abrasive resistant pattern 51. Fasteners, such as bolts 52, are used to secure the pattern 51 to the pattern plate 50. The pattern 51 includes surfaces corresponding to surfaces on the casting as previously described in regard to FIG. 1. Such surfaces include pattern surface 17A which corresponds to the draft gear seat 17 in the casting of FIG. 1. Pattern surfaces 13A and 14A which face each other correspond to the inside wall surfaces of straps 13 and 14, respectively. Surfaces 13B and 14B correspond to the edge surfaces of the straps 13 and 14, respectively. The pattern surfaces 13B and 14B along the midportion of the extended length of the straps are planar and extend obliquely to the face surface of the pattern plate 50 which corresponds to the parting line of the mold flasks. The surfaces 13B and 14B along the midportions of the straps are parallel with the center plane of the coupler yoke casting which is identified in FIG. 5 by reference numeral 53. This center plane is obliquely arranged with respect to the face surface of the pattern plate 50 and forms an angle therebetween in the preferred form of the invention of about 1°. The rear half of the center plane 53 extends from a generally flush relation with the face surface of pattern plate 50 downwardly below the face surface of the pattern plate while the front portion of the center plane extends from a flush relation at the midportion of the pattern upwardly above the face surface of the pattern plate at the front end thereof. Because of the oblique relation of the pattern with respect to the surface of the pattern plate and the added fact that pattern surfaces 13A, 14A and 17A define the entire corresponding surfaces in the ultimate yoke casting, the central portion of the pattern plate is hollowed out to receive the central part of the pattern because the height of the pattern surfaces is about twice the height of, for example, pattern surfaces 13C and 14C. Pattern surfaces 13C and 14C correspond to the outside face surfaces of the straps but only about one-half of their height. At the front portion of the pattern 51, a pattern surface 42A is used to mold sand to produce the sand mold surface 42 as previously described in regard to FIG. 3 for abutment with the core member 32. Other familiar pattern surfaces in FIG. 5 include a raised core print surface 11A to receive the core 32 and formed thereby in the yoke casting, the key slot 11 (FIG. 1). Pattern surface 22A corresponds to the exterior surface of side wall 22 of the yoke casting. The vertical center plane of the pattern corresponds to the horizontal center plane of the yoke casting when orientated for use with a coupler. In a similar way, the horizontal center plane 53 of the pattern corresponds to the vertical center plane of the casting when orientated for use with a coupler. Spaced to the rear of the pattern assembly 51 is a protruding pattern part 55 which forms a runner section in the sand for delivering molten metal into the void area produced in the sand mold. The pattern 51 shown in FIG. 5 includes a wall 56 which extends continuously between pattern surfaces 13A and 14A and between pattern surface 17A and pattern surface 42A. The area in the pattern surrounded by these surfaces forms the upstanding block 37 of molded sand in the drag flask. The top surface of this column of sand is contacted by a depressed molded sand surface in the cope flask which is formed, inter alia, by the cope pattern shown in FIG. 6. The cope pattern in FIG. 6 is identified by reference numeral 57 and includes a broad-width face surface 58 that forms the aforementioned depressed surface in the cope flask. Lightener hole pockets 59 are included in the rear portion of the cope pattern, in the front end portion the cope pattern includes a core print molding surface 10A to form a sand print to receive the core member 32 and form in the yoke casting, the key slot 10. The front end portion of the cope pattern further includes a pattern surface 21A which is used to mold sand to form the exterior surface of side wall 21 in the coupler yoke. Fasteners, such as bolts 59A, are used to secure the cope pattern 57 to a pattern plate 60. The pattern 57 further includes pattern surfaces 13D and 14D that define molded sand surfaces in the cope flask corresponding approximately to one-half of the outside wall surface of straps 13 and 14, respectively. In this regard, as described previously, the drag pattern has surfaces 13C and 14C which correspond approximately to one-half the face surface of the straps 13 and 14 and, therefore, the remaining half of the straps is formed by the pattern surfaces 13D and 14D. Moreover, as indicated in FIG. 6 by reference numeral 61, the horizontal center plane of the cope pattern is obliquely arranged at an angle of about 1° in a direction opposite the oblique arrangement of the drag pattern shown in FIG. 5. The oblique relation between the horizontal center plane 61 and the pattern plate is apparent from the rear portion of the cope pattern containing the lightener openings 59, where the center plane 61 projects above the pattern plate whereas the front portion of the cope pattern, containing pattern surface 21A, is depressed downwardly. The horizontal center plane 61 at the front half of the cope pattern lies below the face surface of the pattern plate 60. As is the common practice, the face surface of the pattern plate 60 defines the parting line of the cope flask when joined with the drag flask to form the mold.

Figure 4:
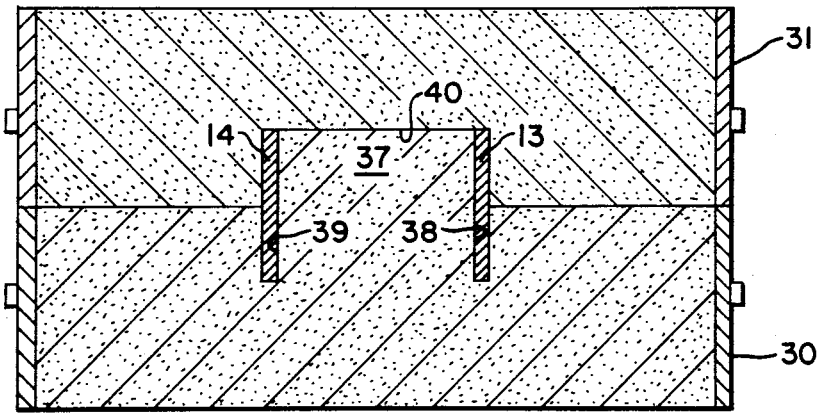
FIG. 4 is a sectional view taken along line IV—IV of FIG. 2.

The width of pattern surface 58 corresponds to the distance between pattern surfaces 13C and 14C of the drag pattern shown in FIG. 5. This is because after the sand is molded with the cope and drag patterns, the flasks when joined together cooperate to produce the mold cavity as shown in FIG. 4 which is particularly characterized by the fact that pattern surface 58 forms the edge surface of the side straps and about one-half of the outside face surface thereof. The cope pattern shown in FIG. 6 further includes the usual riser pattern 62 and down-gate pattern 63. It is to be understood that pattern plates for drag and cope flasks of a mold are usually designed to carry two patterns whereby in the casting process, two yokes are produced by a single molding and pouring procedure. The construction of the pattern assemblies, according to the present invention, is particularly advantageous because by forming the upstanding block 37 of molded sand to produce in the resultant casting, the entire inside wall surface of the yoke straps, the possible occurrence of a rib or offset along the midportion of the straps is eliminated together with the attendant problems usually encountered when fitting the draft gear between the straps in the draft pocket.

In the past, for example, when the pattern parts were constructed to form equal halves of the yoke casting, misalignments between the cope and drag molds and flask parts was a serious problem that particularly occurred during transportation of the mold from the mold assembly area to the pouring floor. When such misalignment occurred between the cope and drag molds and flasks, a step-like configuration occurred on the inside strap wall surface which impeded the assembly of the draft gear into the draft gear pocket or caused the draft gear to tilt out of alignment. When this misalignment between the flasks and molds was greater than about $\frac{1}{8}$ of an inch, the casting was unusable and scrapped. By my novel setup, a smooth, flat face surface on the inside of the straps is always formed since there is no parting line to the patterns midway along these face surfaces of the straps.

While an E-type coupler yoke has been selected for the purpose of disclosing the pattern parts of the present invention, those skilled in the art will readily recognize that the present invention is equally applicable to pattern parts for casting F-type coupler yokes. Moreover, as is well known, F-type coupler yokes differ from E-type coupler yokes essentially only in respect to the formation of a vertical pinhole in the forward end of the coupler yoke to receive the pin used to connect an F-shank of a coupler to the yoke. F-type coupler yokes are symmetrical with respect to horizontal and vertical center planes and employ the same form of draft gear pockets with straps used to interconnect a rear draft gear seat with the front end portion.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A drag pattern assembly to mold sand in a drag mold for cooperative use with a cope mold for casting a coupler yoke for a railway vehicle wherein the coupler yoke includes a rear end portion having a rear draft gear seat at a generally right angle relation with each inside wall of top and bottom straps extending in a generally parallel and spaced-apart relation at either side of one longitudinal center plane of the coupler yoke from said rear end portion to a front end portion, said front end portion having front follower block seats facing toward said rear draft seat, a draft gear pocket being defined within the area surrounded by the rear draft gear seat, the front follower seats and the top and bottom straps, each of said straps having a midportion with opposed side edges each uniformly spaced from a second longitudinal center plane perpendicular to said one longitudinal center plane, said drag mold pattern assembly including a pattern plate having a generally planar face surface area defining a drag mold pattern parting line, a drag pattern defined with a longitudinal center plane oblique to said drag mold pattern parting line, said drag pattern including elongated yoke strap side edge sand molding surfaces with the lengths of each surface uniformly spaced from said longitudinal center plane, said drag pattern further including spaced-apart yoke strap inside wall sand molding surfaces generally perpendicular to a rear draft gear seat sand molding surface with the latter being generally perpendicular to said longitudinal center plane, and fastening means to mount said drag pattern onto said pattern plate with the longitudinal center plane of the drag pattern extending obliquely to the planar face surface area of said pattern plate.

2. The drag pattern assembly of claim 1 wherein said drag pattern includes a core print sand molding surface to receive a core for defining part of a front end draft gear portion of a coupler yoke, and a coupler pocket portion including keyslot ways of a coupler yoke.

3. The drag pattern assembly of claim 2 wherein the core print surfaces on said drag pattern form a single core print for one unitary core.

4. The drag pattern assembly of claim 1 wherein said drag pattern further includes sand molding surfaces to form all surfaces of the rear end portion of a coupler yoke which face a draft gear pocket therein.

5. The drag pattern assembly of claim 1 wherein said planar face surface area intersects said longitudinal center plane at an acute angle of about 1°.

6. The drag pattern assembly of claim 1 wherein said drag pattern further includes spaced-apart yoke strap outside wall sand molding surfaces.

7. The drag pattern assembly according to claim 6 wherein said spaced-apart strap outside wall sand molding surfaces each has a height of about one-half the height of each of said spaced-apart strap inside wall sand molding surfaces.

8. The drag pattern assembly according to claim 1 wherein said rear draft gear seat sand molding surface is flat with a surface area to define the entire sand molding surface for producing a draft gear seat of a coupler yoke.

9. The drag pattern assembly according to claim 1 wherein said spaced-apart yoke strap inside wall sand molding surfaces are each substantially flat with a surface area to define the entire height of a sand molding surface for producing a strap of a coupler yoke.

10. A cope pattern assembly to mold sand in a cope mold for cooperative use with a drag mold for casting coupler yoke for a railway vehicle wherein the coupler yoke includes a rear end portion having a rear draft gear seat at a generally right angle relation with each inside wall of top and bottom straps extending in a generally parallel and spaced-apart relation at either side of one longitudinal center plane of the coupler yoke from said rear end portion to a front end portion, said front end portion having front follower block seats facing toward said rear draft gear seat, a draft gear pocket being defined within the area surrounded by the rear draft gear seat, the front follower block seats and the top and bottom straps, each of said straps having a midportion with an opposed side edge uniformly spaced from a second longitudinal center plane perpendicular to said one longitudinal center plane, said cope mold pattern assembly including a pattern plate having a generally planar face surface area defining a cope mold pattern parting line, a cope pattern defined with a longitudinal center plane oblique to said cope mold pattern parting line, said cope pattern including elongated yoke strap side edge sand molding surfaces with the lengths of each surface uniformly spaced from said longitudinal center plane, said cope pattern further including spaced-apart yoke strap outside wall sand molding surfaces generally perpendicular to both of said longitudinal center plane and said elongated yoke strap side edge sand molding surfaces, and fastening means to mount said cope pattern onto said pattern plate with the longitudinal center plane of the cope pattern extending obliquely to the planar face surface area of said pattern plate.

11. The cope pattern assembly of claim 10 wherein said cope pattern includes a core print sand molding surface to receive a core print for defining part of a front end draft gear portion of a coupler yoke, and a coupler pocket portion including keyslot ways of a coupler yoke.

12. The cope pattern assembly of claim 10 wherein said planar face surface area intersects said longitudinal center plane at an acute angle of about 1°.

* * * * *